US006349493B1

(12) United States Patent
Newman et al.

(10) Patent No.: US 6,349,493 B1
(45) Date of Patent: Feb. 26, 2002

(54) DEBIT WRISTBANDS

(75) Inventors: Karen Newman; Robert A. Praechter, both of St. Louis, MO (US)

(73) Assignee: Moore Business Forms, Inc., NY (US)

( * ) Notice: Subject to any disclaimer, the term of this patent is extended or adjusted under 35 U.S.C. 154(b) by 0 days.

(21) Appl. No.: 08/176,861

(22) Filed: Jan. 3, 1994

(51) Int. Cl.[7] ..... G09F 3/10
(52) U.S. Cl. ..... 40/633; 40/665
(58) Field of Search ..... 40/633, 625, 630, 40/6, 665; 283/75, 107, 109; 428/203

(56) References Cited

U.S. PATENT DOCUMENTS

| | | | | | |
|---|---|---|---|---|---|
| 1,407,239 | A | | 2/1922 | Weiss | 281/51 |
| 1,824,199 | A | | 9/1931 | Donohoe | 40/669 |
| 2,954,620 | A | | 10/1960 | Schneider | 40/633 |
| 3,153,869 | A | | 10/1964 | Twentier | 40/633 |
| 3,656,247 | A | | 4/1972 | Bushnell et al. | 40/633 |
| 3,848,112 | A | | 11/1974 | Weichselbaum et al. | |
| 3,965,589 | A | | 6/1976 | McDermott | 40/633 |
| 4,078,324 | A | | 3/1978 | Wiebe | |
| 4,133,926 | A | * | 1/1979 | Vorrier et al. | 283/75 X |
| 4,311,740 | A | | 1/1982 | Kay | |
| 4,318,234 | A | | 3/1982 | Charles et al. | |
| 4,328,978 | A | | 5/1982 | McLaughlin | |
| 4,464,566 | A | | 8/1984 | Silverman et al. | |
| 4,682,431 | A | | 7/1987 | Kowalchuk | |
| 4,732,411 | A | * | 3/1988 | Siegel | 283/75 |
| 4,835,372 | A | | 5/1989 | Gombrich et al. | |
| 4,879,162 | A | * | 11/1989 | Hansen, Sr. | 40/615 |
| 4,938,830 | A | * | 7/1990 | Cannistra | 283/75 X |
| 5,026,084 | A | * | 6/1991 | Pasfield | 40/633 X |
| 5,153,416 | A | | 10/1992 | Neeley | |
| 5,164,575 | A | | 11/1992 | Neeley et al. | |
| 5,166,498 | A | | 11/1992 | Neeley | |
| 5,181,786 | A | | 1/1993 | Hujink | |
| 5,279,057 | A | * | 1/1994 | Melin et al. | 40/633 X |

FOREIGN PATENT DOCUMENTS

| | | | | |
|---|---|---|---|---|
| EP | 325515 | * | 7/1989 | 40/6 |
| EP | 552656 | * | 1/1993 | 40/625 |

OTHER PUBLICATIONS

1985 Six Flags ticket.

* cited by examiner

*Primary Examiner*—Cassandra H. Davis
(74) *Attorney, Agent, or Firm*—Nixon & Vanderhye PC

(57) ABSTRACT

A wristband is specifically constructed for use in amusement parks having amusement rides or exhibits on or at which human patrons are likely to have the exteriors of their bodies come into contact with chemically treated water, to facilitate purchase of goods or services. The wristband includes a strip of waterproof paper which is tear resistant but will tear completely if subjected to a force which would jeopardize the safety of the wearer in an amusement park environment. Bar coding (e.g. base thirty-six) indicia is imaged on a first face of the strip, and a protective coating (e.g. clear varnish and a transparent matte laminate) is provided over the bar code indicia protecting it from chemically treated water. Aggressive permanent pressure sensitive adhesive is provided at a slitted first end of the strip for securely attaching the ends together so that if they are detached they are not effectively reattachable, and the detachment is clearly visible to the naked human eye. Other indicia or aesthetic graphics are also preferably provided on the wristband. Wristbands are made from a continuous web of paper in a continuous process, and are used in the park by presenting them for scanning at all locations where goods or services may be purchased or consumed.

12 Claims, 3 Drawing Sheets

DEBIT WRISTBANDS

BACKGROUND AND SUMMARY OF THE INVENTION

Most modern amusement parks have water rides and/or exhibits on or at which a patron is likely to come into contact with water, typically chemically treated (with chlorine, bromine, etc.). Such parks are also often frequented on hot and/or muggy days on which many patrons perspire. These factors individually, or in combination, often lead to paper money in the patrons' possession getting soggy, and coins becoming slippery, causing difficulties when the patron purchases goods or services at the amusement park (e.g. food, souvenirs, arcade tokens, show tickets, special ride tickets, etc.). Amusement park owners are reluctant to accept credit cards for many of these purchases both because of the time delays associated with verifying the cards (especially during peak times), and also because fees charged by credit card companies make the return on small purchases unacceptably low. Previous attempts to solve this problem—such as issuing plastic bands that could be ripped into one dollar increments redeemable at concession stands—have been less than successful since they still require users to hassle with coins, do not lend themselves to keeping accurate statistical (e.g. demographic) information, can be easily misplaced, and are fully redeemable by another if lost or stolen. Also, many patrons are reluctant to carry credit cards in parks due to the possibility that they could be lost or stolen, causing substantial difficulties in cancelling them, and/or substantial risk of significant volumes of unauthorized purchases using them.

According to the present invention, the problem described above has been solved in a commercially acceptable manner by using wristbands having bar coding thereon which act like debit cards. Wristbands with bar coding thereon are well known per se, particularly in the medical field. For instance, as shown in U.S. Pat. No. 4,835,372 (the disclosure of which is hereby incorporated by reference herein) and U.S. Pat. No. 5,153,416, essentially conventional hospital plastic wristbands can be used with bar coded indicia, which is read at all places within a hospital where (or at all times when) a patient is in need of treatment, other services, or medicines. However such hospital type wristbands are far from ideal for amusement parks for many reasons, among them the facts that they are not optimally suited for simple, fast, and relatively inexpensive mass production in the type of volumes desired for most amusement parks, and the typical plastic material of which the hospital wristbands are made is highly tear resistant, which could cause a safety problem for a patron in an amusement park under some circumstances, and are not aesthetic.

According to the present invention, a wristband is provided—as well as a method of manufacture thereof—that is virtually ideally suited for use in amusement parks for "debit card" functions. The invention also relates to a unique method of solving the problem of soggy paper money and slippery coins in amusement park environments in a manner which allows demographic or other statistical information to be readily obtained, facilitates theft or unauthorized use prevention, and is very inexpensive.

According to one aspect of the present invention, a wristband for use for a relatively short period of time (e.g. 24 hours or less) in an amusement park environment where it is likely to be exposed to chemically treated water and perspiration, is provided. The wristband comprises: A strip of a first material having first and second faces and which is waterproof and capable of having indicia imaged on the first face, and which is tear resistant but will tear completely if subjected to a force which would jeopardize the safety of the wearer in an amusement park environment if it did not tear, and having first and second ends, the first and second ends being spaced from each other along the length of the strip, and the strip having its length dimension greater than its width dimension, and the length dimension being sufficient to wrap once around the wrist of a human without substantial excess. Bar code indicia (preferably thirty-six base) imaged on the strip first face. A protective coating over the bar code indicia protecting the indicia from chemically treated water. And, attachment means associated with the first and second ends of the strip for securely attaching the first and second ends together so that if they are detached they are not reattachable, and the detachment is clearly visible to the naked human eye.

The first material may comprise approximately 8 point waterproof paper. The bar code may be provided in two distinct areas of the first face, with graphics or indicia visible between the areas. The wristband protective coating may comprise a clear varnish in contact with the first face and the bar code indicia, as well as a waterproof transparent matte laminate (e.g. polyester) covering the clear varnish. Further graphics or indicia may be imaged on the clear varnish, and underlying the waterproof transparent matte laminate. The graphics render the wristband aesthetic, unlike conventional hospital wristbands.

The attachment means preferably comprises an aggressive permanent pressure sensitive adhesive on the second face of the strip at the first end thereof, initially covered by a release sheet, and lines of weakness formed in the strip at the first end thereof where covered by the adhesive, and/or at the second end thereof where engaged by the adhesive. The adhesive and initial release sheet may be provided by transfer paper. The lines of weakness may comprise slits formed in the strip at the first end thereof where covered by the adhesive.

According to another aspect of the present invention, a method of manufacturing wristbands from a continuous web of waterproof paper having first and second faces, is provided. The method comprises the steps of substantially continuously: (a) Imaging bar code indicia on the first face of the continuous web as it moves substantially continuously in a first direction. (b) Applying a protective coating over the bar code indicia and substantially the entire first face of the continuous web. (c) Applying attachment elements to at least the second face of the continuous web at periodic spaced locations along it; and (d) forming lines of weakness in the continuous web at periodic spaced locations to define the continuous web into individual wristbands each having an attachment element associated therewith.

Step (b) is preferably practiced by first applying a transparent varnish over the first face and bar code indicia, and then applying a waterproof transparent matte laminate over the varnish. The method also preferably includes the further step of imaging graphics and/or indicia on the varnish before applying the waterproof transparent matte laminate.

Step (a) is practiced by printing thirty-six base bar code, and step (c) is practiced by applying a piece of transfer tape at each periodic spaced location, comprising an aggressive permanent pressure sensitive adhesive, to the second face. Step (d) is typically practiced by forming a line of weakness is immediately adjacent each piece of transfer tape, and step (c) is further practiced by forming slits in the web at the portion thereof to which the transfer tape has been applied.

Step (d) is desirably practiced by forming perforation lines in the continuous web perpendicular to the direction of movement thereof, in which case the method also includes the further steps of fan-folding the web at the perforation lines, and ultimately separating the web into individual wristbands at the perforation lines.

According to a further aspect of the invention, there is provided a method of facilitating payment for goods or services at an amusement park having amusement rides, exhibits and concessions on or at which human patrons are likely to have the exteriors of their bodies come into contact with chemically treated water. The method comprises the steps of: (a) Providing a waterproof wristband having bar coding thereon. (b) Relating the bar coding to a particular amount of goods or services that the wearer of the wristband is entitled to purchase. (c) Attaching the wristband on a patron's wrist so that the bar coding is readily accessible; and (d) scanning the bar coding on the wristband at various locations within the amusement park where the patron consumes or purchases goods or services, information about the goods or services consumed or purchased being electronically transmitted to a computer.

Step (b) of this method is typically practiced in response to the patron exchanging money for the bar coded wristband; and there is then also preferably the further step (e) of, after a period of time of less than 24 hours from step (c), scanning the bar coding on the wristband to determine if goods or services less than the amount of exchanged money have been purchased by the patron, and then refunding any overpayment. Step (e) is preferably practiced in part by removing the wristband from the patron's wrist in a manner so that it cannot be effectively unnoticeably reattached.

It is the primary object of the present invention to provide an effective method for facilitating purchases of goods or services in amusement parks without cash or credit cards, and to provide a highly suitable wristband (and simple and inexpensive manner of construction thereof) facilitating such purchase-facilitation. This and other objects of the invention will become clear from an inspection of the detailed description of the invention, and from the appended claims.

DETAILED DESCRIPTION OF THE DRAWINGS

Figure 3:
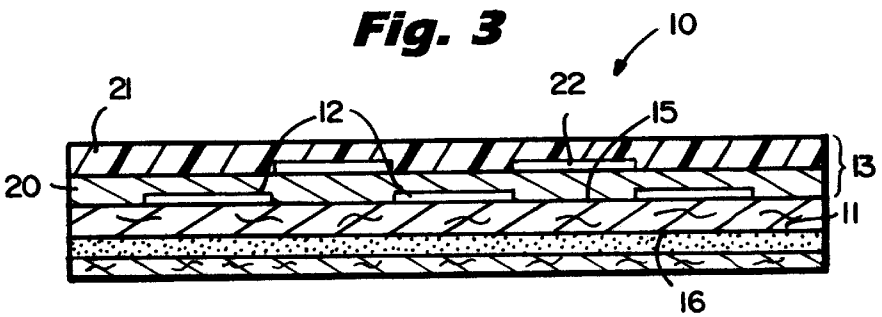
FIG. 3 is a cross-sectional view of the wristband of FIGS. 1 and 2 taken adjustment the end illustrated in FIG. 2, with the individual layers shown greatly exaggerated in size for clarity of illustration.
Figure 4:
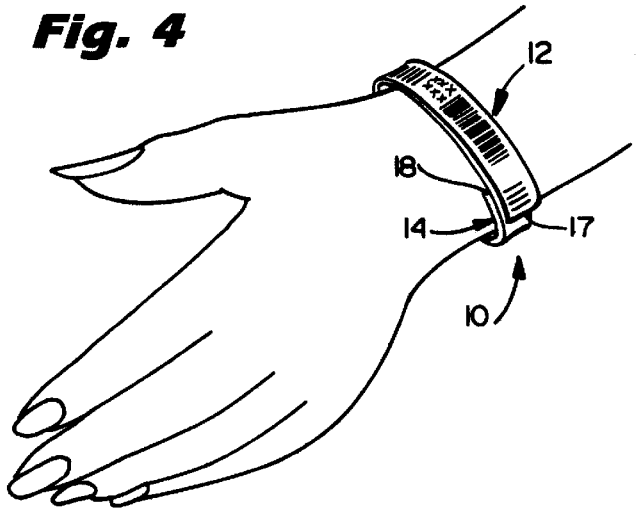
FIG. 4 is a perspective view of a patron's lower arm with the wristband of FIGS. 1–3 attached on the patron's wrist.

An exemplary wristband according to the present invention is shown generally by reference numeral 10 in FIGS. 1–4. The wristband 10 is designed for use for a short period of time in an amusement park environment where it is likely to be exposed to water that is chemically treated (e.g. chlorine and bromine) and perspiration. The main elements of the wristband 10 comprise a strip of a first material 11 (see FIGS. 2 & 3), bar coding shown generally by reference numeral 12 (see FIGS. 1, 3 and 4), a waterproof covering shown generally by reference numeral 13 (see FIGS. 1 & 3), and attachment means 14 (see FIGS. 1, 2, and 4) for attaching the wristband 10 to a patron's wrist, as illustrated in FIG. 4.

The strip 11 of a first material—preferably a waterproof paper—has first and second faces 15, 16 respectively (see FIG. 3), and is capable of having indicia imaged on the first face 15 thereof. The material of the strip 11 is tear resistant but will tear completely if subjected to a force which would jeopardize the safety of the wearer in an amusement park environment if it did not tear; and it has first and second ends 17, 18 (FIGS. 1 and 4), the first and second ends 17, 18 being spaced from each other along the length of the strip 11, and the strip 11 having its length dimension greater than its width dimension, as clearly seen in FIG. 1. The length dimension is sufficient to wrap the wristband 10 once around the wrist of a human without substantial excess material, as seen in FIG. 4. Different sizes/lengths of wristbands 11 may be provided to accommodate patrons of significantly different wrist size. One ideal material for the strip 11 is eight point KIMDURA waterproof paper available from Kimberly Clark, initially provided in continuous web form.

Figure 1:
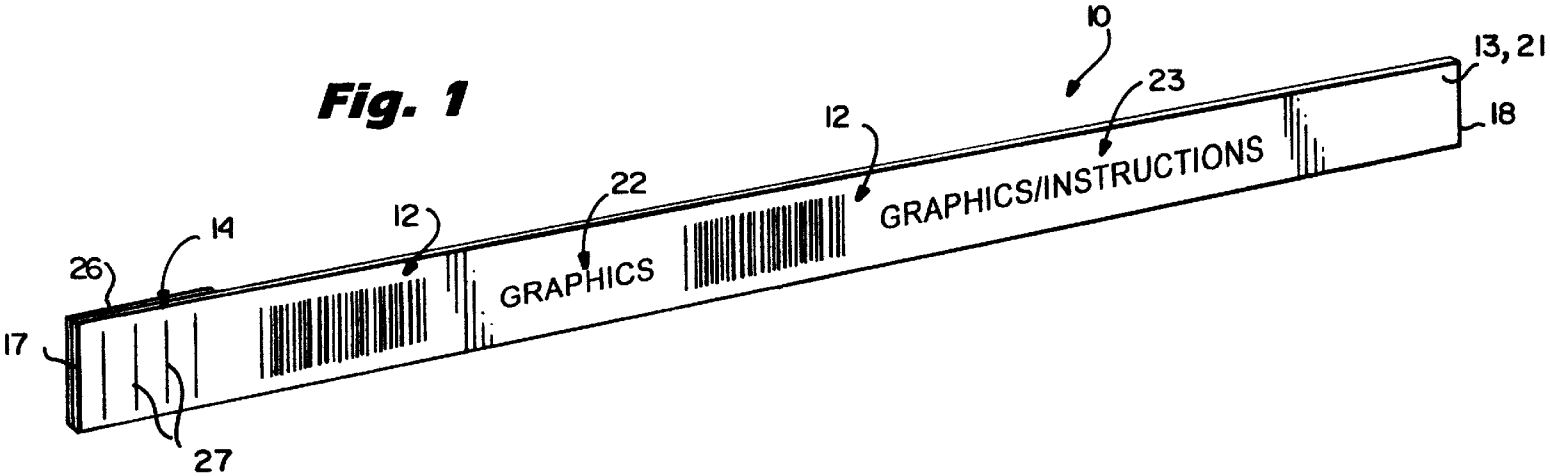
FIG. 1 is a top perspective full scale view of an exemplary wristband according to the present invention.

The bar code indicia 12 imaged on the strip first face 15 may be imaged using an ion deposition printer, or in other conventional manners. Preferably the indicia 12 is base thirty-six bar code. This code is a small, though readily readable, size code which allows the width of the wristband 10 to be minimized, and allows room for graphics, instructions, or other indicia on other portions of the face 15. As seen in FIG. 1, preferably two distinct, spaced, bar code groups 12 are provided.

The protective coating 13 over the bar code indicia 12 is provided to protect the indicia from chemically treated water, and may comprise a wide variety of types. Preferably, the coating 13 comprises a clear varnish layer 20 (see FIG. 3)—such as protective clear varnishes, or WVG 001028, a clear high gloss moisture resistant varnish, all available from Water Ink Technologies of Cincinnati, Ohio—directly on the face 15 and over the bar code indicia 12, and a second waterproof layer 21. The layer 21 preferably comprises a waterproof transparent matte laminate, such as a one mil thick polyester available from Em-Tech of Medina, Ohio. Aesthetic graphics 22 (see FIGS. 1 and 3) and/or instructional indicia 23 or the like may be imaged on the face 15, or—as shown in FIG. 3—imaged on the varnish 20, and covered by the laminate 21.

The attachment means 14 is typically associated with the first and second ends 17, 18 of the strip 11, and are for securely attaching the first and second ends 17, 18 together (see FIG. 4) so that if they are detached they are not effectively reattachable, and the detachment is clearly visible to the naked human eye. The attachment means preferably comprises an aggressive permanent pressure sensitive adhesive 25 (see FIG. 2) on the second face 16 of the strip 11 at the first end 17 thereof, initially covered by a release sheet 26, and lines of weakness 27 formed in the strip 11 at the first end 17 thereof where the strip 11 is covered by the adhesive 25. Under some circumstances, the lines 27 could alternatively or additionally be provided at the second end 18 where engaged by the adhesive 25. The adhesive 25 and release sheet 26 (shown as transparent in FIG. 2) may be provided by a piece of transfer tape, such as "Extra Tack" transfer tape, available from Moore Business Forms of Lake Forest, Ill.

Figure 2:
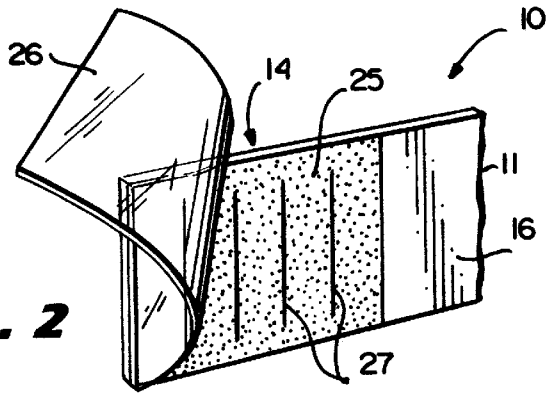
FIG. 2 is a bottom perspective view of only one end of the wristband of FIG. 1, showing a release sheet portion of a piece of transfer tape release paper being removed from its associated adhesive.

The lines of weakness 27 preferably comprise (as seen in FIGS. 1 and 2) security slits formed in the strip 11 at the first end 17 thereof where covered by the adhesive 25, the slits 27 extending in the width dimension of the strip 11. Typically the matte laminate layer 21 is not provided over the area containing the slits since the layer 21 might prevent proper functioning of slits 27. The slits 27 are provided in number and extent, taking into account the aggressiveness of the adhesive 25, its adherence to the strip 11 face 15 (or the coating 13 thereon) at the end 18, and the strength of the waterproof paper forming the strip 11, so that if detachment of the ends 17, 18 is attempted once they have been adhesively secured together (as seen in FIG. 4), the strip 11 will rupture at the slits 27, making effective unnoticeable (to the naked human eye) reattachment of the band 10 ends 17, 18 with the band 10 around the wrist (as seen in FIG. 4) impossible. That is the rupture (detachment) will be clearly visible to the naked human eye.

Figure 5:
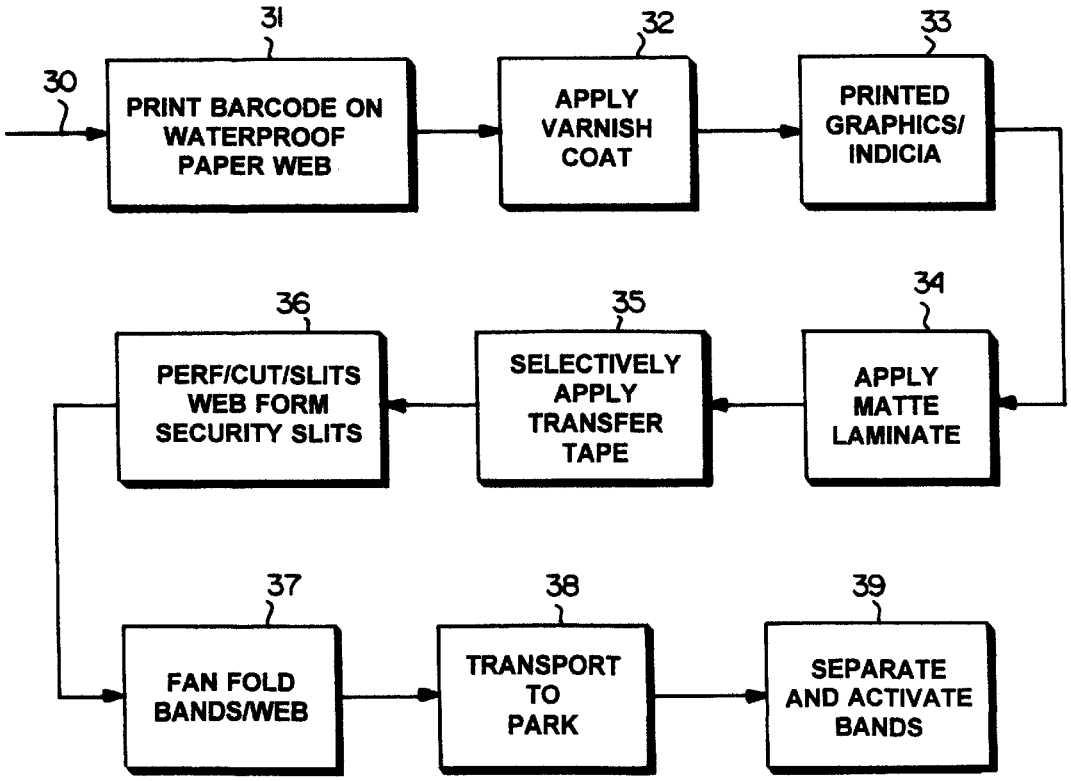
FIG. 5 is a schematic diagram showing exemplary method steps that may be practiced to produce the wristband of FIGS. 1–4.

FIG. 5 illustrates in a box diagram various exemplary method steps that may be practiced according to the inventive method of making a wristband 10. While the sequence illustrated in FIG. 4 is preferred, various steps may be practiced at different points in the sequence with comparable results.

The method of FIG. 4 is practiced using a continuous web of waterproof paper, such as KIMDURA. The web—shown schematically at 30 in FIG. 4—is caused to substantially continuously move in a given direction (using conventional web transport equipment), and while it is one face thereof—corresponding to the face 15 of FIG. 3—is imaged (as shown by box 31) with thirty-six base bar coding 12 (or a like concentrated information machine readable indicia). Imaging may be accomplished using an ion deposition printer (e.g. a MIDAX printer), or other suitable printer. Then clear varnish coat 20 is applied over the face 15 and bar coding 12, as indicated at 32. Graphics and/or other indicia 22, 23 may be printed directly on face 15, or—as shown by box 33—then may be printed on varnish 15. Once all graphics and indicia have been applied, the waterproof transparent matte laminate 21 is applied at 34; except that the laminate 21 is not provided on that portion of face 15 which will have the slits 27 formed therein.

Pieces of transfer tape 25, 26 are applied to the bottom face of the web 30 (i. e. the face 16 in FIGS. 2 and 3) at spaced locations along the length of the web 30 using conventional techniques, as shown by box 35. The application of transfer tape is preferred, although an application of adhesive 25 and separate application of a release sheet 26 may be provided in some circumstances, or the release sheet 26 could be eliminated if the wristbands 10 are supplied in a stack and the top face 15 at end 17 of each wristband 10 is coated with a release material over substantially the same area that the bottom face 16 is coated with the adhesive 25.

After adhesive 25 application, the web 30 is acted upon to form lines of weakness which divide the web into individual wristbands 11, as indicated at 36, and the slits 27 are also preferably formed at that time, or shortly therebefore or thereafter. The lines of weakness, which are perpendicular to the direction of travel of web 30, preferably are perforation lines, although they could be complete severance cuts. If perforation lines, or the like, the web is then preferably fan folded—as illustrated at 37. At stage 36 the web may also be slit longitudinally (in a conventional manner) if initially it was much wider than the width of a wristband 10 so as to provide multiple strips 11 from each web width. After fan folding, the web 30 is transported—see 38—to the amusement park where used as indicated at 39, and there the individual bands 10 are detached from the web 30 along the perforations, and the bar coding 12 activated.

Figure 6:
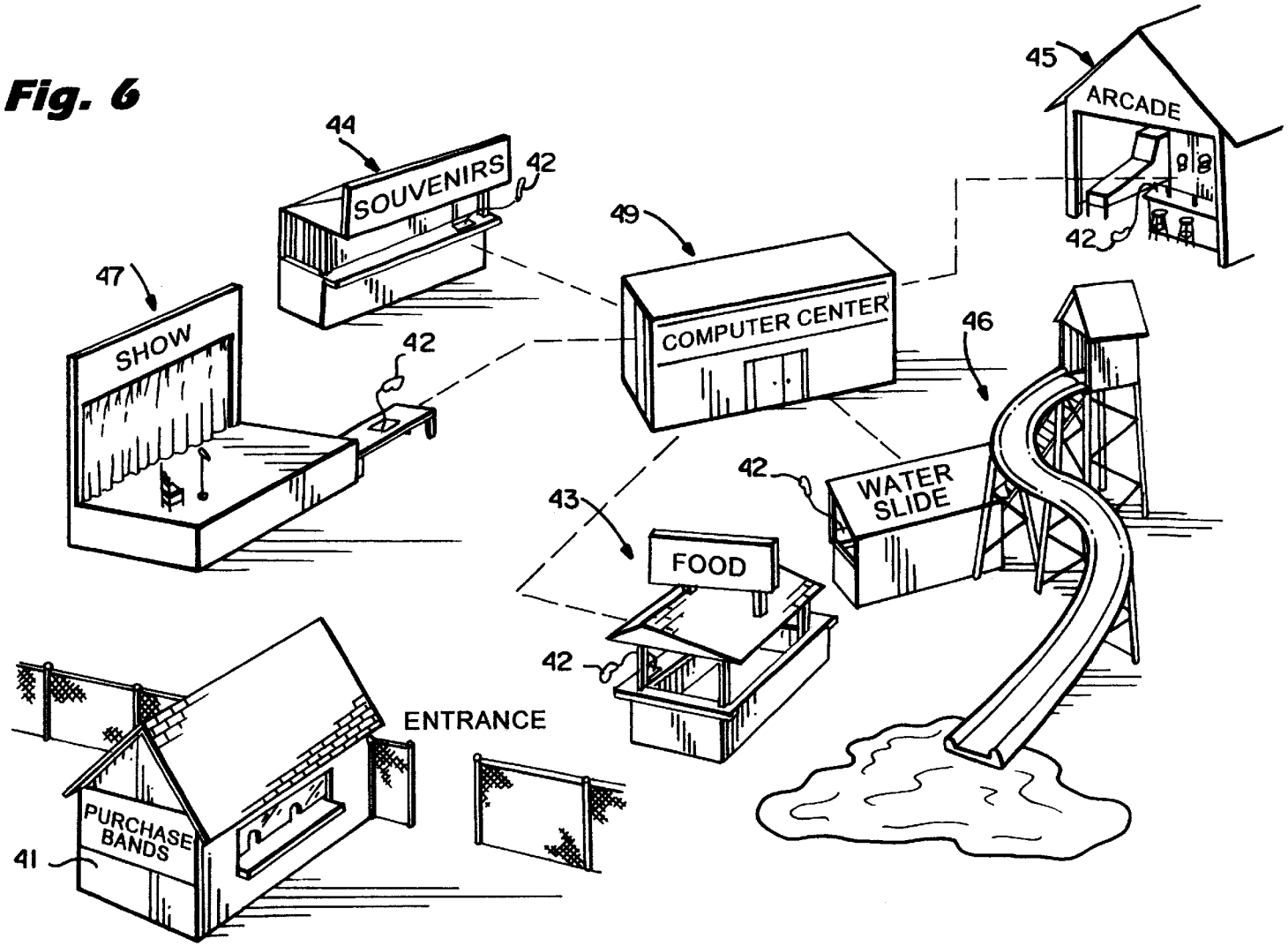
FIG. 6 is a schematic perspective showing exemplary parts of an amusement park for utilizing the wristbands of FIGS. 1–4.

An amusement park is shown schematically in FIG. 6. At the park the wristbands 10 may be sold at the entrance or locker room building 41, the correct amount being applied thereto as is conventional for debit card systems which use bar coding, and the release paper 26 removed and the adhesive 25 attached to the top face 15 (or coating 13 thereon) of the strip 11 at the second end 18 thereof, as seen in FIG. 4. The bar coding can be read at numerous locations within the park, for the purchase of goods or services, scanners 42 being provided at food concessions or restaurants 43, souvenir booths 44, arcades 45, rides 46, and/or shows 47, as well as all other conventional facilitates in amusement parks. Exactly where the scanners 42 are used will depend upon what facilities within the park are included in the price of admission (e.g. most rides and shows at some parks, but few or none at others), a scanner 42 being provided at each facility or exhibit at which cash or credit cards would normally be needed by a patron.

All of the scanners 42 are typically connected to a central computer 49, and the computer 49 keeps track of the purchases using the wristbands 10, just as in a conventional debit card system. Preferably, the bands 10—and the coding 12 thereof—is designed so that the bands 10 are only good for one 24 hour period (or one business day), and then will no longer be valid when scanned with scanners 42. At the end of a day, a patron goes to a suitable location (e.g. building 41), has the wristband 10 destructively removed and scanned, and is refunded (in cash or credit to the credit card which purchased the band 10) any excess "money" on the band 10.

The system and method described above also make the tracking of demographic, or other statistical data, simple. Demographic data may simply be input into the computer 49 corresponding to each uniquely identified wrist band coding 12, so that purchases by any particular class of people (e.g. children under 12) can be tracked. Also, if a band 10 is stolen or lost, by contacting park personnel the band 10 can be cancelled at the computer center 49 so that no further purchases are allowed on it. The manner in which the computer 49 is programmed, and all of the variable techniques that may be utilized for debiting or tracking, are conventional or otherwise not a part of this invention.

It will thus be seen that according to the present invention a highly desirable wristband that replaces cash or credit cards for amusement parks has been provided, as well as advantageous methods of manufacture and use thereof. While the invention has been herein shown and described in what is presently conceived to be the most preferred and practical embodiment thereof, it is to be understood that the invention is to be accorded the broadest interpretation of the appended claims so as to encompass all equivalent structures and methods.

What is claimed is:

1. A wristband for use for a short period of time in an amusement park environment where it is likely to be exposed to chemically treated water and perspiration, comprising:

an elongated strip of a first material having a length, first and second faces, and which is waterproof and capable of having indicia imaged on said first face, and having first and second ends, said first and second ends being spaced from each other along the length of said strip, and said strip having a length dimension greater than a width dimension, and said length dimension being sufficient to wrap once around a human being's wrist without substantial excess;

bar code indicia imaged on said strip first face;

a protective coating over said bar code indicia protecting said indicia from chemically treated water; and attachment means associated with said first and second ends of said strip for securely attaching said first and second ends together so that if they are detached they are not effectively reattachable, and the detachment is clearly visible to the naked human eye, wherein said protective coating comprises a clear varnish in contact with said first face and said bar code indicia, wherein said protective coating further comprises a waterproof transparent matte laminate covering said clear varnish.

2. A wristband as recited in claim 1 further comprising graphics or indicia imaged on said clear varnish, and underlying said waterproof transparent matte laminate.

3. A wristband as recited in claim 2 wherein said attachment means comprises an aggressive permanent pressure sensitive adhesive on said face of said strip at said first end thereof, initially covered by a release sheet, and lines of weakness formed in said strip at said second end thereof where engaged by said adhesive; said transparent matte laminate not covering said strip at said lines of weakness.

4. A wristband as recited in claim 3 wherein said lines of weakness comprise slits formed in said strip at said first end thereof where covered by said adhesive.

5. A wristband as recited in claim 4 wherein said first material comprises approximately 8 point waterproof paper.

6. A wristband as recited in claim 2 wherein said attachment means comprises an aggressive permanent pressure sensitive adhesive on said second face of said strip at said first end thereof, initially covered by a release sheet, and lines of weakness formed in said strip at said first end thereof where covered by said adhesive, said transparent matte laminate not covering said strip at said lines of weakness.

7. A wristband as recited in claim 6 wherein said lines of weakness comprise slits formed in said strip at said first end thereof where covered by said adhesive.

8. A wristband as recited in claim 7 wherein said first material comprises approximately 8 point waterproof paper.

9. A method of facilitating payment for goods or services at an amusement park having amusement rides, exhibits, and concessions on or at which human patrons' bodies are likely to come into contact with chemically treated water, comprising the steps of:

(a) providing a waterproof wristband having bar coding thereon;

(b) relating the bar coding to a particular amount of goods or services that a human patron wearer of the wristband is entitled to purchase;

(c) attaching the wristband on a human patron's wrist so that the bar coding is readily accessible; and (d) scanning the bar coding on the wristband at various locations within the amusement park where the patron consumes or purchases goods or services, information about the goods or services consumed or purchased being electronically transmitted to a computer.

10. A method as recited in claim 9 wherein step (b) is practiced in response to the patron exchanging money for the bar coded wristband; and comprising the further step (e) of, after a period of time of less than 24 hours from step (c), scanning the bar coding on the wristband to determine if goods or services less than the amount of goods and services that have been purchased by the human patron.

11. A method as recited in claim 10, wherein step (e) is practiced in part by removing the wristband from the human patron's wrist in a manner so that it cannot be effectively unnoticeably reattached.

12. A method as recited in claim 9 comprising the further step of removing the wristband from the human patron's wrist in a manner such that it cannot be effectively unnoticeably reattached.

* * * * *